US006014797A

United States Patent [19]

Kuster et al.

[11] Patent Number: 6,014,797

[45] Date of Patent: Jan. 18, 2000

[54] METHOD AND APPARATUS FOR UNRAVELLING THREADS

[75] Inventors: Stephan Kuster; Heinz Kuster, both of Sandpoint, Id.

[73] Assignee: JWI Ltd., Kanata, Canada

[21] Appl. No.: 08/876,470

[22] Filed: Jun. 16, 1997

[51] Int. Cl.[7] ..... D06H 5/00

[52] U.S. Cl. ..... 28/146; 28/141; 26/10.4

[58] Field of Search ..... 28/141, 145, 146, 28/170, 171; 26/10.4, 7, 11, 12; 139/170.4, 302, 383 AA, 446

[56] References Cited

U.S. PATENT DOCUMENTS

| | | | |
|---|---|---|---|
| 796,484 | 8/1905 | Wilms | 28/146 |
| 2,845,686 | 8/1958 | Mason | 28/1 |
| 3,413,700 | 12/1968 | Abowitz | 28/171 |
| 4,410,015 | 10/1983 | Koller et al. | 139/383 A |
| 4,557,025 | 12/1985 | Eglin | 28/141 |
| 4,581,794 | 4/1986 | Oldroyd et al. | 28/141 |
| 4,736,499 | 4/1988 | Kopcke | 28/141 |
| 4,860,411 | 8/1989 | Vohringer | 28/141 |
| 4,972,561 | 11/1990 | Aldrich | 28/142 |
| 4,985,970 | 1/1991 | Krenkel et al. | 28/141 |
| 5,027,483 | 7/1991 | Anderson | 28/141 |
| 5,183,081 | 2/1993 | Kuster et al. | 139/59 |
| 5,212,858 | 5/1993 | Anderson | 28/141 |
| 5,217,415 | 6/1993 | Wasylezuck et al. | 474/256 |
| 5,355,911 | 10/1994 | Kuster et al. | 139/55.1 |
| 5,390,708 | 2/1995 | Kuster et al. | 139/383 AA |
| 5,411,063 | 5/1995 | Hacker et al. | 28/141 |
| 5,421,373 | 6/1995 | Hacker et al. | 139/192 |
| 5,720,323 | 2/1998 | Tremer | 28/141 |

FOREIGN PATENT DOCUMENTS

| | | |
|---|---|---|
| 0 236 601 | 9/1987 | European Pat. Off. . |

*Primary Examiner*—Amy B. Vanatta
*Attorney, Agent, or Firm*—Baker & Daniels

[57] ABSTRACT

A method and apparatus for automatically unravelling a fringe area in a fabric is provided. The apparatus uses a reciprocating, hooked needle and a reciprocating blade to pull weft threads from the plane of a fabric and cut them off. The needle and hook are advanced in the direction of the warp threads, unravelling the weft threads until a fringe area of a certain width has been formed. The apparatus is then displaced along the edge of the fabric and the unravelling cycle is repeated. The apparatus continues to be moved along the edge of the fabric until the fringe area extends the length of the edge.

14 Claims, 5 Drawing Sheets

METHOD AND APPARATUS FOR UNRAVELLING THREADS

FIELD OF THE INVENTION

The present invention relates to a method and apparatus for preparing a woven material for seaming. In particular, the present invention relates to a method and device for the automated unravelling, cutting and removal of weft threads or fibres in a woven material to prepare a fringe for seaming.

BACKGROUND OF THE INVENTION

Devices such as industrial paper making machines require continuous lengths of woven fabric to provide, for example, forming fabrics, drying webs and pressing felts and other industrial fabrics. To form a continuous length, opposite ends of a length of fabric must be joined together. Also, shorter lengths of fabric can be joined by seams to form a longer length of fabric, Generally, a woven scam is preferred, because it provides a smoother, flatter join which is important in many applications, such as paper making. In order to weave the ends of fabric together in a seam, weft, or lateral, threads are removed from each fabric end in a process called unravelling to expose a section of warp, or longitudinal, threads called a fringe. The fringes of the ends of the fabric to be joined are then overlayed and the warp yarns are reentered, or rewoven, to form the seam.

The formation of the seam is generally an automated reweaving process. However, it is difficult and time consuming to prepare fringes for the seaming process. Typically, the unravelling of a fabric to prepare a fringe is performed manually, in a time consuming and labour intensive process. Usually, the manual preparation of fabric edges is performed on fringe preparation tables where an operator manually cuts short sections of the weft threads and then pulls these sections out of the fabric.

The fabric used in commercial paper making machines may be 30 feet, or more, in width. In addition to the time and labour required to unravel such fabric to provide a fringe, the repetition and monotony of the unravelling operation can lead to repetitive stress injuries in the workers preparing the fringes. Additionally, if the sections of cut weft thread are too long, or the force used to pull them out is too great, the underlying warp threads can be damaged, resulting in discontinuities in the eventual seam. In addition, the crimp, or deformation of the warp threads can be destroyed, making it difficult to reenter the warp threads to create the woven seam.

U.S. Pat. No. 4,736,499, entitled "Equipment for Unravelling Threads from a Fabric", to Köpcke, describes a device which attempts to automate the unravelling process to provide a fringe suitable for spiral seaming. Spiral seaming involves the insertion of a plastic spiral into a narrow fringed channel across the width of the two ends to be joined. In this device, an unravelling unit using vertically reciprocating needles in combination with a cutter, pulls out and cuts sections of weft thread. The unit travels across the width of the fabric unravelling a number of threads which corresponds to the number of needles used.

However, problems exist in the device taught by Köpcke in that it can only remove a number of weft threads equal to the number of needles provided. If a wider fringe is desired, the unit must be repositioned and the unravelling process repeated across the entire width of the fabric. Further, while a narrow fringe, typically only two to ten threads in width, is sufficient for spiral seaming, a woven scam typically requires the fringe to be from about 1" to about 10" in width, which may necessitate the removal of hundreds of weft threads. With the Köpcke device, many passes of the device across the fabric would be required.

In addition, Köpcke employs a mechanical sensor, following the channel between two adjacent weft threads, to ensure straight tracking of the unravelling unit. Accordingly, the equipment may not track properly across fabrics with a tight weave, or with modern fabrics which have a more complex, multi-layered weave. As well, since Köpcke employs a trailing cutter to cut the pulled treads after they have been released by the needles, it may not function adequately on soft-fibred fabrics, as soft threads may not be stiff enough to maintain their position as the cutter is moved into them.

SUMMARY OF THE INVENTION

It is an object of the present invention to provide a novel method and apparatus for automated unravelling of weft threads in a woven material to provide a fringe for seaming.

According to a first aspect of the present invention, there is provided an apparatus for unravelling weft threads to form a fringe in a woven fabric web having a lateral edge substantially parallel to said weft threads, comprising:

fabric holding means supporting a portion of said fabric web;

an unravelling assembly including an unravelling needle, first reciprocation means for reciprocally driving said needle substantially perpendicular to said web wherein, in a first direction, said needle pierces said fabric, and, in a second direction, said needle captures and unravels at least one weft thread from said fabric, a cutter adjacent said needle for cutting said at least one unravelled weft thread, and second reciprocation means for selectively driving said cutter to cut said at least one weft thread;

longitudinal displacement means for moving said unravelling assembly, in incremental steps, a preselected distance toward said weft threads, and returning said unravelling assembly to a starting position detected by a sensing means; and lateral displacement means for moving said apparatus a preselected distance along said edge.

According to another aspect of the present invention, there is provided a method of forming a fringe by unravelling weft threads in a woven fabric web having a lateral edge, comprising the steps of:

(i) retaining a portion of said fabric in a fabric holding means;

(ii) piercing said fabric with an unravelling needle, said needle being substantially perpendicular to said fabric;

(iii) retracting said needle from said fabric such that a book on said needle captures at least one weft thread and pulls said at least one weft thread away from said fabric;

(iv) cutting said at least one weft thread with a cutter adjacent said needle;

(v) incrementally advancing said needle and said cutter longitudinally into said fabric;

(vi) repeating steps (ii) through (v) until a preselected width threads have been unravelled, cut arid removed;

(vii) returning said needle and cutter to a longitudinal starting position;

(viii) releasing said portion of fabric;

(ix) laterally displacing said needle, said cutter and said fabric holding means a preselected distance along said lateral edge to a position wherein the weft threads have not yet been removed; and (x) repeating steps (i) through (ix) until a fringe is formed across said fabric web.

According to yet another aspect of the present invention, there is provided an apparatus for completing a seam between ends of a woven fabric, comprising:

first and second unravelling apparatuses for unravelling weft threads to form a fringe in respective ones of said ends of a woven fabric, each end having a lateral edge substantially parallel to said weft threads, comprising:

fabric holding means supporting a portion of said fabric web;

an unravelling assembly including an unravelling needle, first reciprocation means for reciprocally driving said needle substantially perpendicular to said web wherein, in a first direction, said needle pierces said fabric, and, in a second direction, said needle captures and unravels at least one weft thread from said fabric, a cutter adjacent said needle for cutting said at least one unravelled weft thread, and second reciprocation means for selectively driving said cutter to cut said at least one waft thread;

longitudinal displacement means for moving said unravelling assembly, in incremental steps, a preselected distance toward said weft threads, and returning said unravelling assembly to a starting position detected by a sensing means;

lateral displacement means for moving said apparatus a preselected distance along said edge; and a seaming machine spaced from said first and second unravelling apparatuses and operating on the unravelled portion of each end of said woven fabric formed thereby to weave a seam between said ends.

BRIEF DESCRIPTION OF THE DRAWINGS

Preferred embodiments of the present invention will now be described, by way of example only, with reference to the attached Figures in which.

DETAILED DESCRIPTION OF THE DRAWINGS

Figure 1:
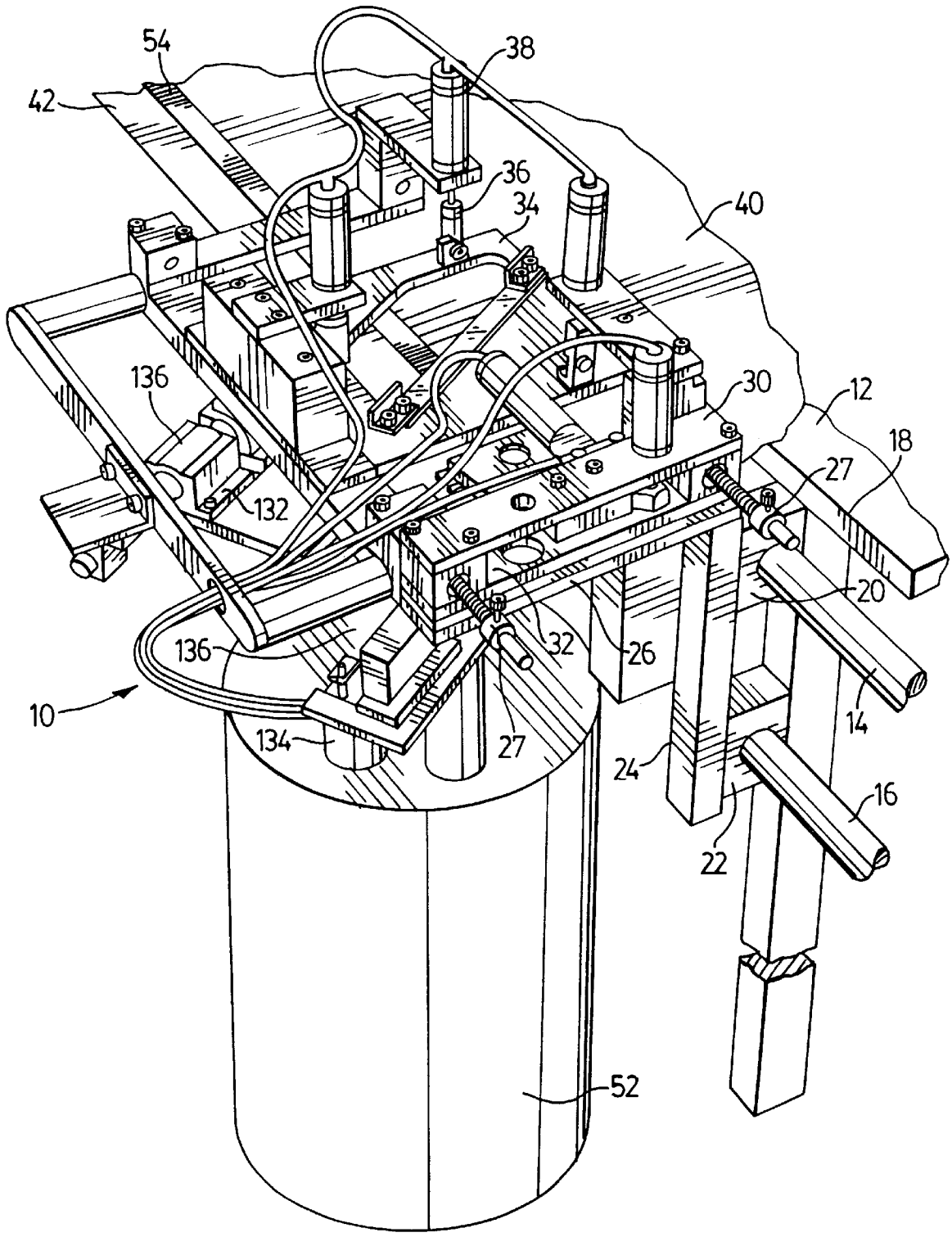
FIG. 1 is a perspective view of an unravelling apparatus, having a ball thread driven unravelling assembly, in accordance with the present invention.

An unravelling apparatus according to an embodiment of the present invention is illustrated in FIG. 1 and generally designated by reference numeral 10. Apparatus 10 is attached to a conventional fringe preparation table 12 by standard guide rails 14 and 16. Apparatus 10 includes upper and lower guide members 20 and 22 which are slidably attached to guide rails 14 and 16 and an inverted L-shaped support frame 24 which is rigidly connected to guide members 20, 22. The upper segment of the inverted L-shaped support frame 24 forms a base plate 26 extending across apparatus 10, and is further described below. Apparatus 10 is thus moveable, along guide rails 14 and 16, laterally across table 12. As is described below, apparatus 10 moves across table 12 in a series of steps wherein an unravelling cycle is performed in each step and the lateral width of each cycle is controlled by adjusting shaft collars 27.

In a presently preferred embodiment apparatus 10 is pneumatically driven along guide rails 14 and 16, in any suitable manner as will occur to those of skill in the art. As will be apparent, any other suitable means of driving apparatus 10 can also be employed, such as stepper motors etc.

Figure 2:
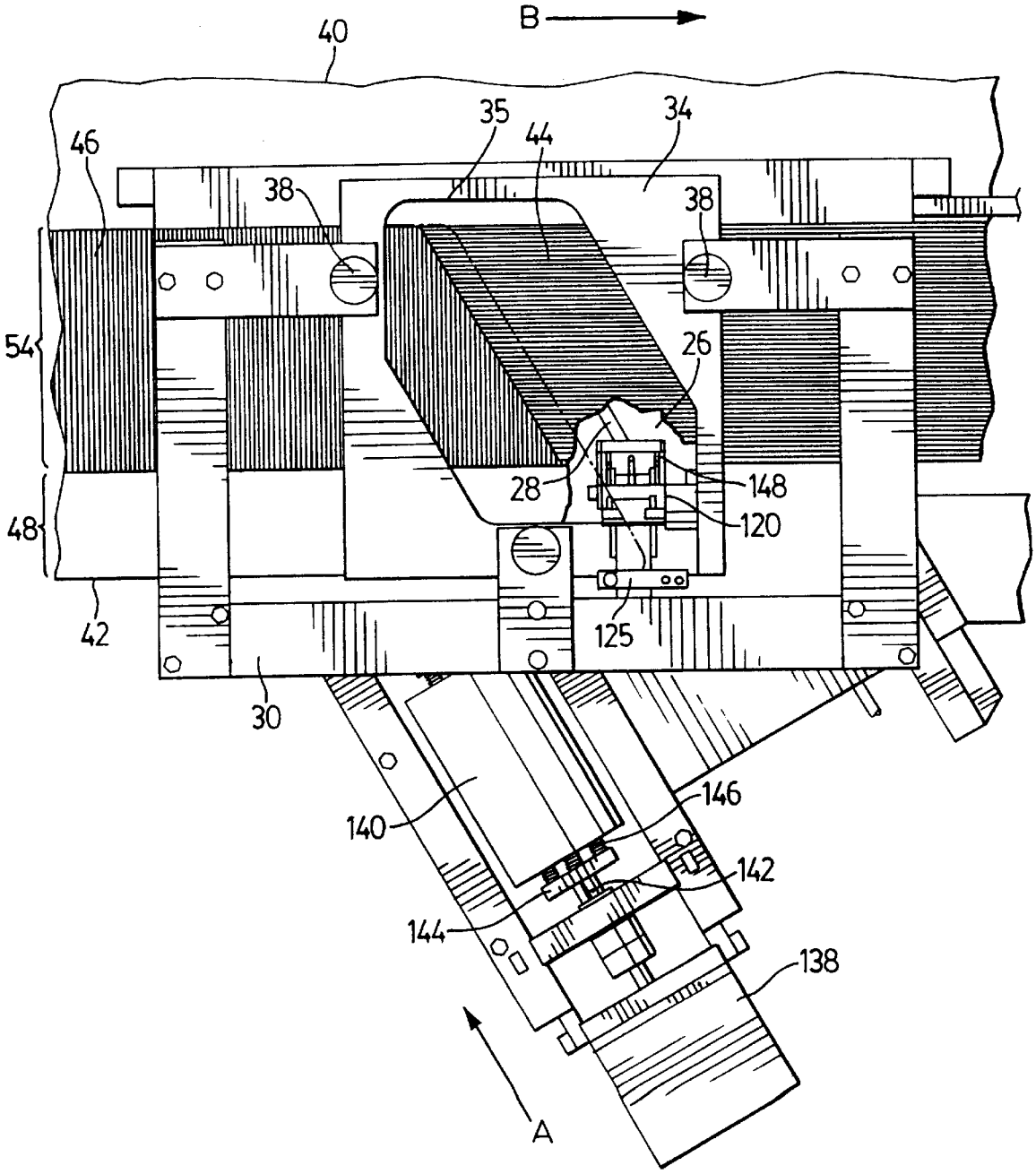
FIG. 2 is a top view of an unravelling apparatus, having a lead screw driven unravelling assembly, in accordance with the present invention.
Figure 3:
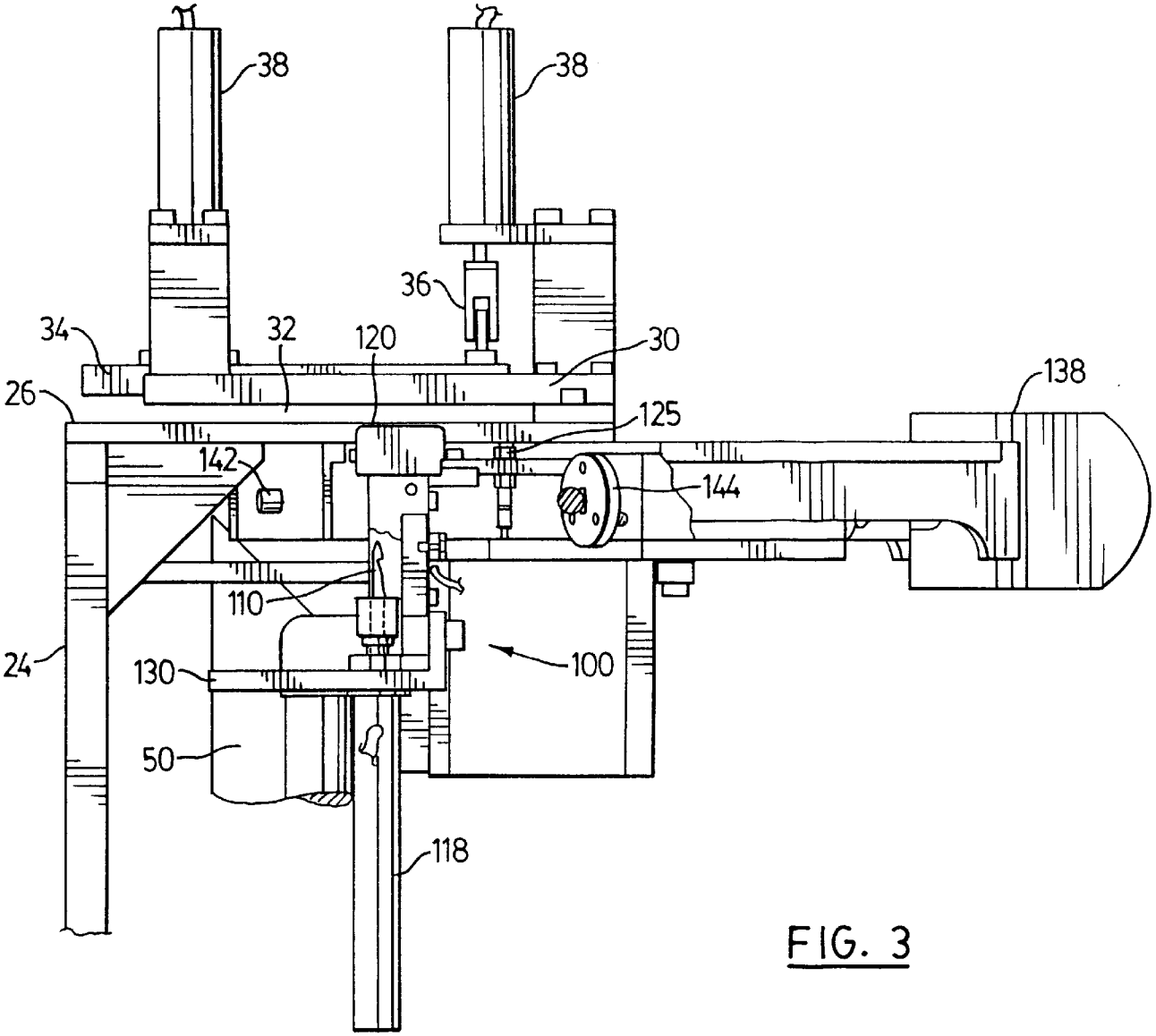
FIG. 3. is a side view of the apparatus of FIG. 2.

Referring now to FIGS. 2 and 3, base plate 26 is positioned to be level with the top of table 12, and is pierced by a guide channel 28, preferably running at a non-perpendicular angle across the base plate 26, as will be more fully explained below.

A generally U-shaped upper frame 30 is fastened to base plate 26 with an open gap 32 between base plate 26 and upper frame 30. Upper frame 30 can be formed of several connected sections, as best seen in FIGS. 2 and 3, or it may be a single machined component.

A clamping plate 34, having an opening 35, is suspended above base plate 26 by arms 36 which are attached to three pneumatically driven piston cylinders 38. When clamping plate 34 is urged downwardly against base plate 26 by pneumatic cylinders 38, a portion of a fabric web 40 is retained in position between them, as shown in FIG. 2.

Figure 4:
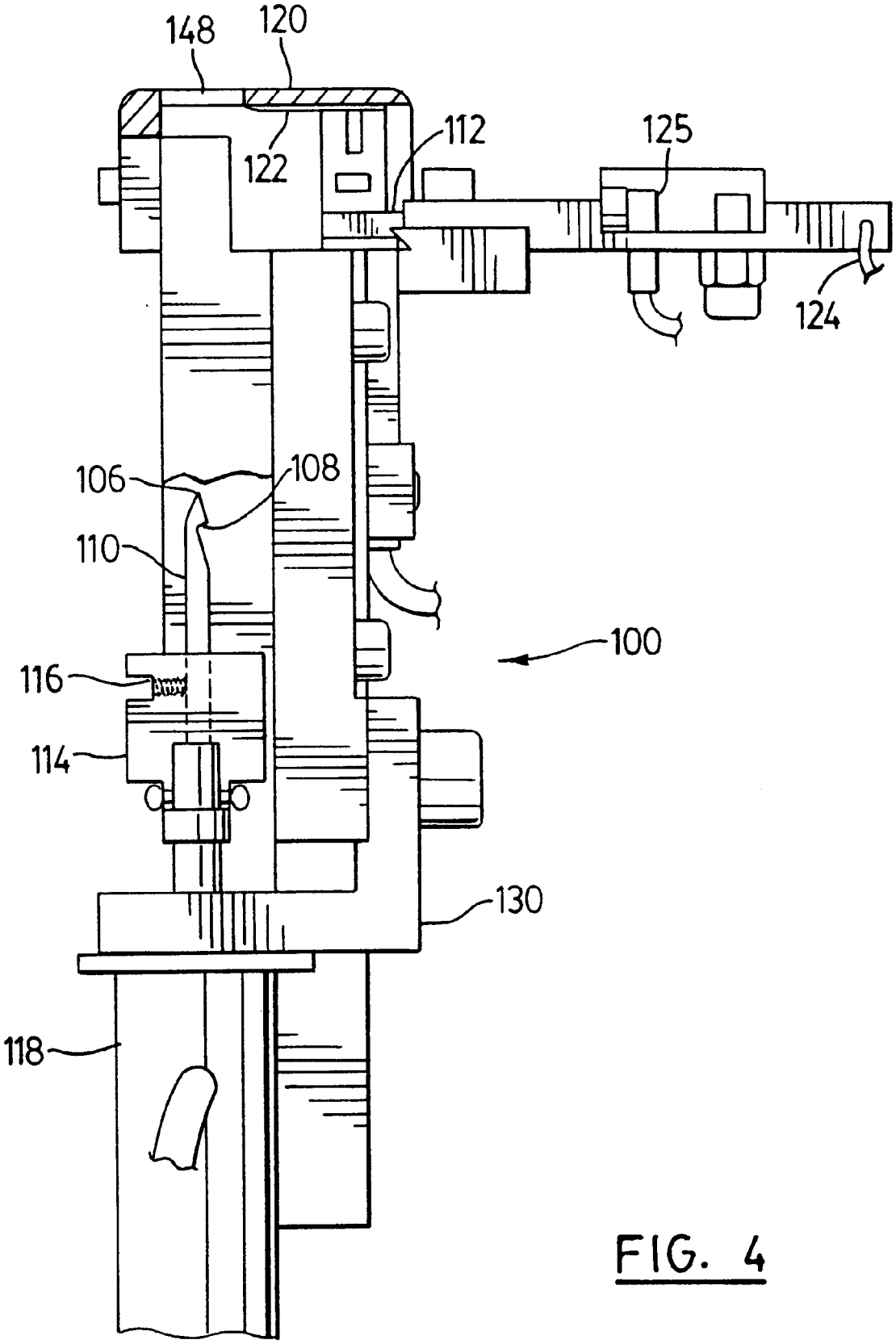
FIG. 4 is a side view of an unravelling assembly, in accordance with the present invention.

An unravelling assembly, generally designated as 100 and best seen in FIG. 4, is mounted beneath base plate 26. As disclosed herein, unravelling assembly 100 includes both means of pulling one or more weft threads from the plane of the fabric and means for subsequently cutting the threads. As used herein, the term "threads" is intended to comprise monofilament threads, fibres, etc., from which a woven fabric is formed.

The means for pulling one or more weft threads from tie plane of a fabric which comprises a vertically reciprocating unravelling needle 110, having a pointed end 106 and an inwardly cut hook 108 and the means for cutting the threads comprises a horizontally reciprocating cutter 112 mounted perpendicular to needle 110. Needle 110 is held at its base in a needle block 114 by a set screw 116. Needle block 114 is, in turn, attached to a pneumatic piston cylinder 118 which moves needle 110 towards and away from an unravelling head 120.

A vacuum system 50 is positioned beneath base plate 26, adjacent to unravelling assembly 100 and removes from the fabric threads cut by the thread cutting means.

Cutter 112 consists of a reciprocating blade 122 which is pneumatically driven, via hose 124, from its first position, as illustrated, towards needle 110. As will be apparent to those of skill in the art, while presently preferred, it is not essential that blade 122 be pneumatically driven and any other suitable drive means as will occur to those of skill in the art can be employed. An optical sensor 125 is fixed behind reciprocating cutter 112.

Unravelling assembly 100, supported by a bracket 130, moves below base plate 26, and can be advanced by any other suitable means as will occur to those of skill in the art. As shown in the embodiment of FIG. 1, a standard DC motor and gear assembly 134 drives a ball thread drive 136 to move unravelling assembly 100, along rails 132, in a generally longitudinal direction in relation to base plate 26 (i.e. toward or away from the weft threads). Alternatively, as shown in FIGS. 2 and 3, unravelling assembly 100 may be driven by a stepper motor 138 and a conventional lead screw assembly 140, including a lead screw 142, a lead nut 144, and spring tensioners 146. Apart from the manner by which unravelling assembly 100 is moved longitudinally, apparatus 10 in FIG. 1 is identical to apparatus 10 in FIGS. 2 and 3.

In operation, a lateral edge 42 of fabric web 40 is placed between base plate 26 and clamping plate 34 such that weft threads 44 run substantially parallel to guide rails 14 and 16, and warp treads 46 run substantially perpendicular thereto. It will be appreciated that the edges of soft fabrics may have to be supported along their length to ensure that the fabric does not stretch unduly, or pull away from apparatus 10 and suitable techniques for supporting such fabricates will be apparent to those of skill in the art.

Unravelling assembly 100 is positioned at a star position, such that edge 42 is detected by optical sensor 125. Sensor 125 and unravelling head 120 are separated by a preselected distance, as best seen in FIG. 2. Generally, this distance will be approximately 1 to 2 inches, depending on the fabric to be fringed and this separation ensures that the weft threads in a strip 48 of fabric, running along the edge of the web 40 will remain uncut to inhibit tangling of the warp threads after the fringe is formed.

With unravelling head 120 in the start position in relation to edge 42, an unravelling cycle begins. Clamping plate 34 is pushed downwards by cylinders 38, thereby holding a portion of web 40 taut against base plate 26, over guide channel 28 and an opening 148 in uravelling head 120 which is coincident therewith. Needle 110 is moved upwardly, passing through opening 148, and piercing the fabric with pointed end 106. The direction of needle 110 is then reversed, pulling it downwardly through the fabric. As hook 108 passes through the fabric on the downward stroke, it captures one or more weft threads 44 and pulls them out of the plane of the fabric. Blade 122 is then advanced towards the pulled weft threads and cuts them off at the rear of the fabric and blade 122 is then retracted. Suction from vacuum system 50 pulls the cut portion of the weft thread, and any dust, lint or other debris from the cutting, into a vacuum container 52 to keep the work area clean.

Different needles can be mounted in unravelling assembly 100 by loosening set screw 116, removing needle 110, inserting a new needle and retightening set screw 116. The dimensions of needle 110, including the shape and size of hook 108, can be chosen to suit the nature of the woven fabric to be unravelled, as will be apparent to those of skill in the art. The dimensions chosen can, for example, depend on thread diameter and the looseness of the weave of a particular fabric. The shape and size of hook 108 will also determine the number of threads to be pulled out in a single downstroke. For example, a multi-layered fabric will have weft threads in each layer which may be generally aligned, and which will be captured by relatively large hook 108 as it descends.

After one or more weft threads have been cut and removed, as described above, unravelling assembly 100 is then moved an incremental distance along guide channel 28, in the direction of the arrow marked A in FIG. 2, moving needle 110 longitudinally toward the next weft thread and the above sequence is repeated. The incremental step by which unravelling assembly 100 is moved is dictated by the nature of the fabric being prepared for seaming. As will be apparent to those skilled in the art, fabrics with higher weft thread densities will require smaller incremental steps for apparatus 10 than will fabrics with lower weft thread densities.

In a preferred embodiment, a slight tension is also applied to the weft threads, in a direction opposite the arrow marked A in FIG. 2, as the weft threads are pulled out the plane of the fabric. This tension is provided by spring tensioners 146 such that the captured weft thread is urged back along the warp threads to an area already unravelled. This reduces tension on, and possible deformation of the crimp in, warp threads as the weft threads are pulled out and increases the ease with which the cut lengths of wet thread can be removed from the work area by vacuum system 50.

Unravelling assembly 100 continues to move into fabric 40 until fringe area 54 is a preselected width along the line of the warp threads. The width of fringe area 54 will determine the eventual seam width, and can, for example, be in the range of from about 1 inch to about 10 inches.

It will be noted that guide channel 28, in the illustrated embodiment, is angled approximately 30 degrees from the line of the warp threads 46 and away from the direction of lateral travel of apparatus 10, as indicated by the arrow marked B in FIG. 2. This angling is presently preferred as it is believed to inhibit tangling and bunching of the ends of the weft threads 44. As will be apparent to those skilled in the art the degree of angling can be chosen according to the nature of the fabric. For higher density fabrics, a greater angle may be preferred, while for low density fabrics, a smaller angle, or no angle may be preferable.

After the fringe area 54 has been unravelled to the preselected width by a cycle of the unravelling assembly 100, the assembly 100 is returned to the start position, as detected by sensor 125. Clamping plate 34 releases the fabric portion, and apparatus 10 is then longitudinally displaced a preselected distance along guide rails 14 and 16 where the unravelling cycle is repeated. The distance by which apparatus 10 is moved along guide rails 14 and 16 determines the length of the cut wet threads and is set with collars 127.

A cut length, and accordingly, a longitudinal displacement, of approximately one inch has been found to be practical for most fabrics. It will however be appreciated that the longer the cut thread, the greater the chance of damaging or stretching the warp threads. Conversely, the shorter the cut thread, the greater the number of unravelling cycles which will be required to provide a fringe area along the length of the fabric.

The unravelling cycle and the longitudinal displacement are repeated until fringe area 54 has been formed along the entire length of web 40, after which strip 48 can be removed by any suitable technique.

It will be clear to those of skill in the art that the present invention allows for the automation of a previously labour intensive, manual process of fringe preparation. Fringes of any width may be prepared automatically and at great speed in comparison to manual unravelling, or previous automated systems. Once apparatus 10 is properly configured and positioned, fringe of a fabric is completed entirely autonomously.

Figure 5:
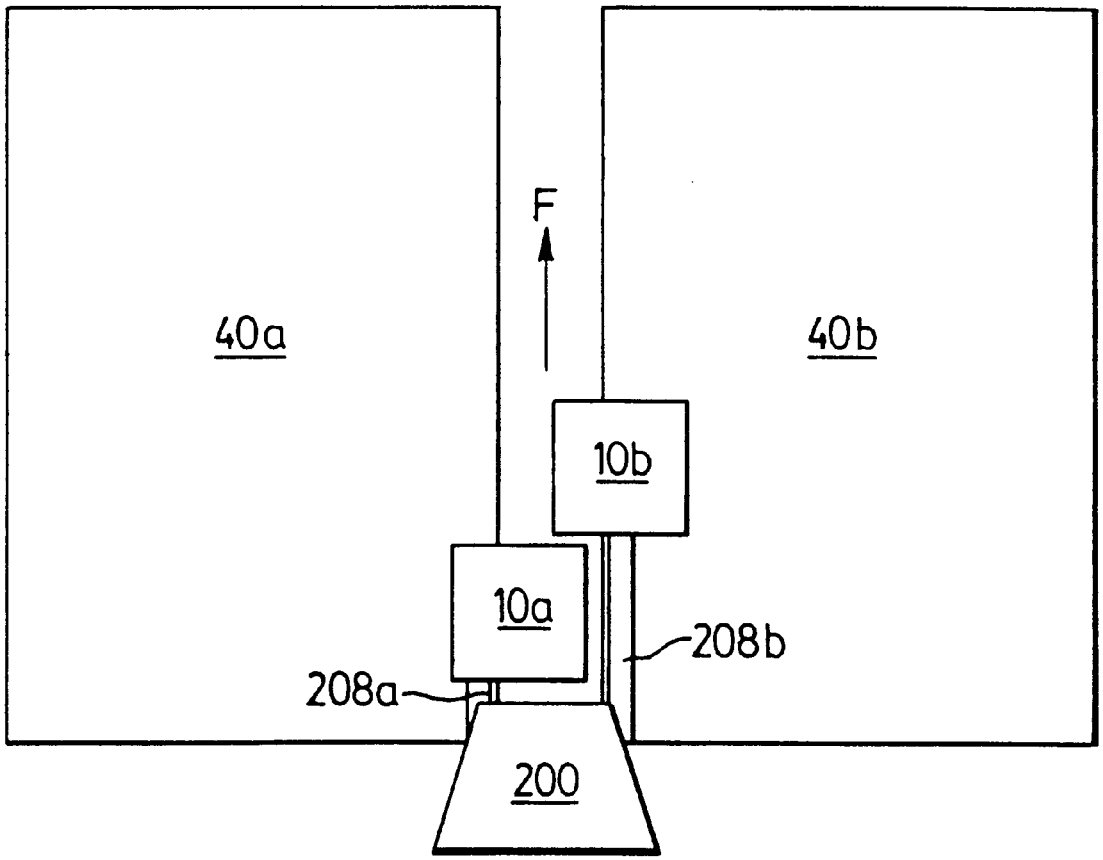
FIG. 5 is a block diagram representing the use of two unravelling apparatuses in accordance with the present invention in combination with a seaming device.

It is contemplated that, as indicated in FIG. 5, in many applications two unravelling apparatuses 10*a* and 10*b* will be employed with an existing seaming machine 200 to simultaneously unravel both ends of a fabric web 204. In such a case, fringes 208*a* and 208*b* are formed by apparatuses 10*a* and 10*b*, respectively, and these fringes 208*a*, 208 *b* are fed to seaming machine 200 as the three devices traverse fabric webs 40*a*, 40*b* in the direction shown by arrow F. As shown, apparatus 10*b* is spaced from apparatus 10*a*, in the direction of arrow F, to permit the edges of fabric webs 40*a*, 40*b* and the resulting fringes 208*a*, 208*b*, to be located relatively close to each other to be seamed. While other suitable configurations of apparatuses 10*a* and 10*b* and seaming machine 200 will be apparent to those of skill in the art, combining the unravelling and seaming operations in one entirely automated operation is believed to represent a significant advantage and provide savings in both cost and time.

Though the present invention has been described in relation to a fabric web held generally horizontally, it will be apparent that apparatus 10 can be turned to remove weft threads from a vertical web section.

It will be apparent to those skilled in the art that the foregoing is by way of example only. Modifications, variations and alterations may be made to the described embodiments without departing from the scope of the invention which is defined solely in the claims.

We claim:

1. An apparatus for unravelling weft threads to form a fringe in a woven fabric web having a lateral edge substantially parallel to said weft threads, comprising:

fabric holding means supporting a portion of said fabric web;

an unravelling assembly including an unravelling needle, first reciprocation means for reciprocally driving said needle substantially perpendicular to said web wherein, in a first direction, said needle pierces said fabric, and, in a second direction, said needle captures and unravels at least one weft thread from said fabric, a cutter adjacent said needle for cutting said at least one unravelled weft thread, and second reciprocation means for selectively driving said cutter to cut said at least one weft thread;

longitudinal displacement means for moving said unravelling assembly, in incremental steps, a preselected distance toward said weft threads, and returning said unravelling assembly to a starting position detected by a sensing means; and lateral displacement means for moving said apparatus a preselected distance along said edge.

2. An apparatus according to claim 1 wherein said longitudinal displacement means moves said unravelling assembly across said weft threads at a non-perpendicular angle thereto.

3. An apparatus according to claim 2 wherein said angle is approximately 30 degrees.

4. An apparatus according to claim 1 including tensioning means for urging said unravelling assembly away from said weft threads.

5. An apparatus according to claim 1 wherein said sensing means is an optical sensor.

6. An apparatus according to claim 5 wherein said optical sensor is spaced from said unravelling needle such that a portion of said fabric adjacent said lateral edge is not unravelled.

7. A apparatus according to claim 1 further including a vacuum system for removing cut weft threads.

8. An apparatus for completing a seam between ends of a woven fabric, comprising:

first and second unravelling apparatuses for unravelling weft threads to form a fringe in respective ones of said ends of a woven fabric, each end having a lateral edge substantially parallel to said weft threads, comprising:

fabric holding means supporting a portion of said fabric web;

an uravelling assembly including an unravelling needle, first reciprocation means for reciprocally driving said needle substantially perpendicular to said web wherein, in a first direction, said needle pierces said fabric, and, in a second direction, said needle captures and unravels at least one weft thread from said fabric, a cutter adjacent said needle for cutting said at least one unravelled weft thread, and second reciprocation means for selectively driving said cutter to cut said at least one weft thread;

longitudinal displacement means for moving said unravelling assembly, in incremental steps, a preselected distance toward said weft threads, and returning said unravelling assembly to a starting position detected by a sensing means;

lateral displacement means for moving said apparatus a preselected distance along said edge; and a seaming machine spaced from said first and second unravelling apparatuses and operating on the unravelled portion of each end of said woven fabric formed thereby to weave a seam between said ends.

9. A method of forming a fringe by unravelling weft threads in a woven fabric web having a lateral edge, comprising the steps of:

(i) retaining a portion of said fabric in a fabric holding means;

(ii) piercing said fabric with an unravelling needle, said needle being substantially perpendicular to said fabric;

(iii) retracting said needle from said fabric such that a hook on said needle captures at least one weft thread and pulls said at least one weft thread away from said fabric;

(iv) cutting said at least one weft thread with a cutter adjacent said needle;

(v) incrementally advancing said needle and said cutter longitudinally into said fabric;

(vi) repeating steps (ii) through (v) until a preselected width of weft threads have been unravelled, cut and removed;

(vii) returning said needle and cutter to a longitudinal starting position;

(viii) releasing said portion of fabric;

(ix) laterally displacing said needle, said cutter and said fabric holding means a preselected distance along said lateral edge to a position wherein the weft threads have not yet been removed; and (x) repeating steps (i) through (ix) until a fringe is formed across said fabric web.

10. A method according to claim 9 wherein said longitudinal advancing of step (v) is performed through a non-perpendicular angle to said lateral edge.

11. A method according to claim 10 wherein said angle is approximately 30 degrees.

12. A method according to claim 9 where in step (vi) said cut weft threads are removed via vacuum means.

13. A method according to claim 9 wherein said longitudinal starting position is spaced from said lateral edge by a preselected distance.

14. A method according to claim 9 wherein steps (i) through (x) are performed substantially simultaneously on each of two adjacent fabric ends to form adjacent fringes and comprising the additional step of forming a seam between said adjacent fringes.

* * * * *